US009223242B2

(12) United States Patent
Suzuki et al.

(10) Patent No.: US 9,223,242 B2
(45) Date of Patent: Dec. 29, 2015

(54) IMAGE FORMING APPARATUS

(71) Applicant: CANON KABUSHIKI KAISHA, Tokyo (JP)

(72) Inventors: Tetsuji Suzuki, Fujisawa (JP); Takeo Kawanami, Fujisawa (JP); Masao Amano, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/186,725

(22) Filed: Feb. 21, 2014

(65) Prior Publication Data

US 2014/0233987 A1 Aug. 21, 2014

(30) Foreign Application Priority Data

Feb. 21, 2013 (JP) ..... 2013-031841

(51) Int. Cl.
*G03G 15/01* (2006.01)

(52) U.S. Cl.
CPC .... *G03G 15/0189* (2013.01); *G03G 2215/0132* (2013.01); *G03G 2215/0193* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,765,082 | A * | 6/1998 | Numazu et al. | 399/299 |
| 6,108,514 | A * | 8/2000 | Nakayama et al. | 399/400 |
| 7,092,657 | B2 | 8/2006 | Nakashima et al. | |
| 7,466,939 | B2 | 12/2008 | Nakashima et al. | |
| 7,561,840 | B2 * | 7/2009 | Morimoto et al. | 399/299 |
| 7,813,683 | B2 | 10/2010 | Furuya et al. | |
| 2010/0080617 | A1 * | 4/2010 | Noguchi | 399/112 |
| 2012/0243884 | A1 * | 9/2012 | Mimura | 399/12 |

FOREIGN PATENT DOCUMENTS

JP 2009-128580 A 6/2009

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image forming apparatus includes a first image bearing member; a plurality of second image bearing members; an endless belt opposing the first and second image bearing members; a driving roller; a supporting roller; a first transfer member opposing the first image bearing member; a plurality of second transfer members provided opposing the second image bearing members; and a supporting member for supporting the second transfer members. The supporting member is movable between a first position as a contact position and a second position as a spaced position. When image formation is effected in a state in which the supporting member is positioned in the first position, a nip between the first image bearing member and the belt member is positioned to be spaced from a rectilinear line connecting contact positions of the belt member with the second image bearing members.

28 Claims, 11 Drawing Sheets

IMAGE FORMING APPARATUS

FIELD OF THE INVENTION AND RELATED ART

The present invention relates to an image forming apparatus of an electrophotographic image forming type or the like in which an image is formed on a recording material (medium). Particularly, the present invention relates to an image forming apparatus of a tandem type including a plurality of rotatable image bearing members which are successively arranged in a predetermined direction and on which images different in color are to be formed.

Here, the image forming apparatus forms the image on the recording material by using an electrophotographic image forming process or the like. As the image forming apparatus, there are, e.g., a copying machine, a printer (e.g., a color LED printer) a facsimile machine, and a word processor. Further, on the recording material, the image is formed by the image forming apparatus, and the recording material may include, e.g., a sheet, an OHP sheet, and the like (hereinafter referred to as the sheet).

As a conventional color image forming apparatus, an electrophotographic image forming apparatus employing the tandem type has been known. The tandem type is a type in which a plurality of electrophotographic photosensitive (members) drums (hereinafter referred to as a drum) as image bearing members provided correspondingly to developers (hereinafter referred to as toners) of respective colors are arranged in line, and in which toner images carried on the respective drums are transferred superposedly onto a transfer receiving member (material) to obtain a desired color tone. As the transfer receiving member, e.g., an intermediary transfer material such as an endless intermediary transfer belt may be used (intermediary transfer type), and a sheet which is fed by a feeding member and onto which the toner image is directly transferred from the drum may also be used (direct transfer type).

In the image forming apparatus of the tandem type, output of color images of yellow (Y), magenta (M), cyan (C) and black (Bk) is not always required but output of a monochromatic image such as a black (Bk) image is required in not a few cases. Further, also a constitution in which the monochromatic image is obtained in a state in which all of the drums are contacted to the transfer receiving member and in which rotational drive of the drums other than the drum for black is stopped has been known. However, according to this constitution, friction is generated between the fed transfer receiving member and the drums for the colors other than black, and therefore generates a problem such that the transfer receiving member and the drums are liable to deteriorate.

As a countermeasure against this problem, there is a constitution in which when the output of Bk, in order to extend lifetimes of the drums and developing devices for Y, M and C other than Bk, transfer members for Y, M and C are spaced (separated) from the corresponding drums. For example, there is a constitution, as described in Japanese Laid-Open Patent Application (JP-A) 2009-128580, in which in order to move transfer rollers for Y, M and C toward or away from the drums, the transfer rollers for Y, M and C are contacted to or spaced from the transfer receiving member by being linearly moved vertically. Further, there is a constitution, as described in U.S. Pat. No. 7,813,683, in which in order to move the transfer rollers for Y, M and C toward or away from the drums, a pushing-up roller is contacted to or spaced from the transfer receiving member.

In the image forming apparatus in JP-A 2009-128580, even when the transfer rollers for Y, M and C are spaced from the drums during the output of Bk, an attitude of the transfer receiving member is determined by the transfer roller for Bk and a member for stretching the transfer receiving member. In this case, it would be considered that a distance of the drums for Y, M and C, particularly the drum for C, adjacent to the drum for Bk, from the transfer receiving member cannot be increased sufficiently. It would be also considered that in the case where the sufficient distance cannot be ensured, e.g., in the case where the transfer receiving member is in a waved state, the transfer receiving member contacts the drums for Y, M and C and thus the transfer receiving member and the drums are liable to deteriorate.

Further, in the image forming apparatus in U.S. Pat. No. 7,813,683, when the Bk image is outputted, the transfer receiving member is spaced directly by the pushing-up roller, and therefore it is possible to expect an effect of sufficiently increasing the distance of the drums for Y, M and C from the transfer receiving member. However, in the image forming apparatus in U.S. Pat. No. 7,813,683, there is a need to provide the pushing-up roller itself and a mechanism for causing the pushing-up roller to be contacted to or spaced from the transfer receiving member. Further, the pushing-up roller is contacted to the transfer receiving member during the output of the monochromatic image, and therefore a mechanism for applying a voltage (bias), of the same polarity as the polarity of the toner, to the pushing-up roller is needed. Therefore, the number of parts was increased, and the image forming apparatus was upsized for ensuring spaces for these parts.

SUMMARY OF THE INVENTION

The present invention has been accomplished in view of the above-described circumstances.

A principal object of the present invention is to provide an image forming apparatus capable of sufficiently increasing a distance of image bearing members for Y, M and C from a transfer receiving member during output of an image of, e.g., Bk in a relatively simple constitution without upsizing the image forming apparatus.

According to an aspect of the present invention, there is provided an image forming apparatus for forming an image on a recording material, comprising: a rotatable first image bearing member; a plurality of rotatable second image bearing members; an endless belt provided rotatably opposed to the first image bearing member and the second image bearing members; a driving roller for rotating the belt member in contact with an inner peripheral surface of the belt member; a supporting roller for supporting the belt member in contact with the inner peripheral surface of the belt member; a first transfer member provided opposed to the first image bearing member via the belt member; a plurality of second transfer members provided opposed to the second image bearing members, respectively, via the belt member; and a supporting member for movably supporting the second transfer members, wherein the supporting member is movable between a first position in which the second transfer members are placed in a state in which the second transfer members are contacted to the belt member together with the second image bearing members to sandwich the belt member therebetween, and a second position in which the second transfer members are retracted from the first position to space the second image bearing members and the second transfer members from the belt member, wherein when image formation is effected in a state in which the supporting member is positioned in the first position, a nip between the first image bearing member and the belt member is positioned to be spaced from a rectilinear line connecting contact positions of the belt member with the second image bearing members.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be specifically described with reference to the drawings. However, dimensions, materials, shapes, relative arrangements and the like of constituent elements described in the following embodiments are appropriately changed depending on constitutions or various conditions of devices (apparatuses) to which the present invention is applied. Therefore, the scope of the present invention is not limited thereto unless otherwise specified.

Embodiment 1

(Image Forming Apparatus)

Figure 1:
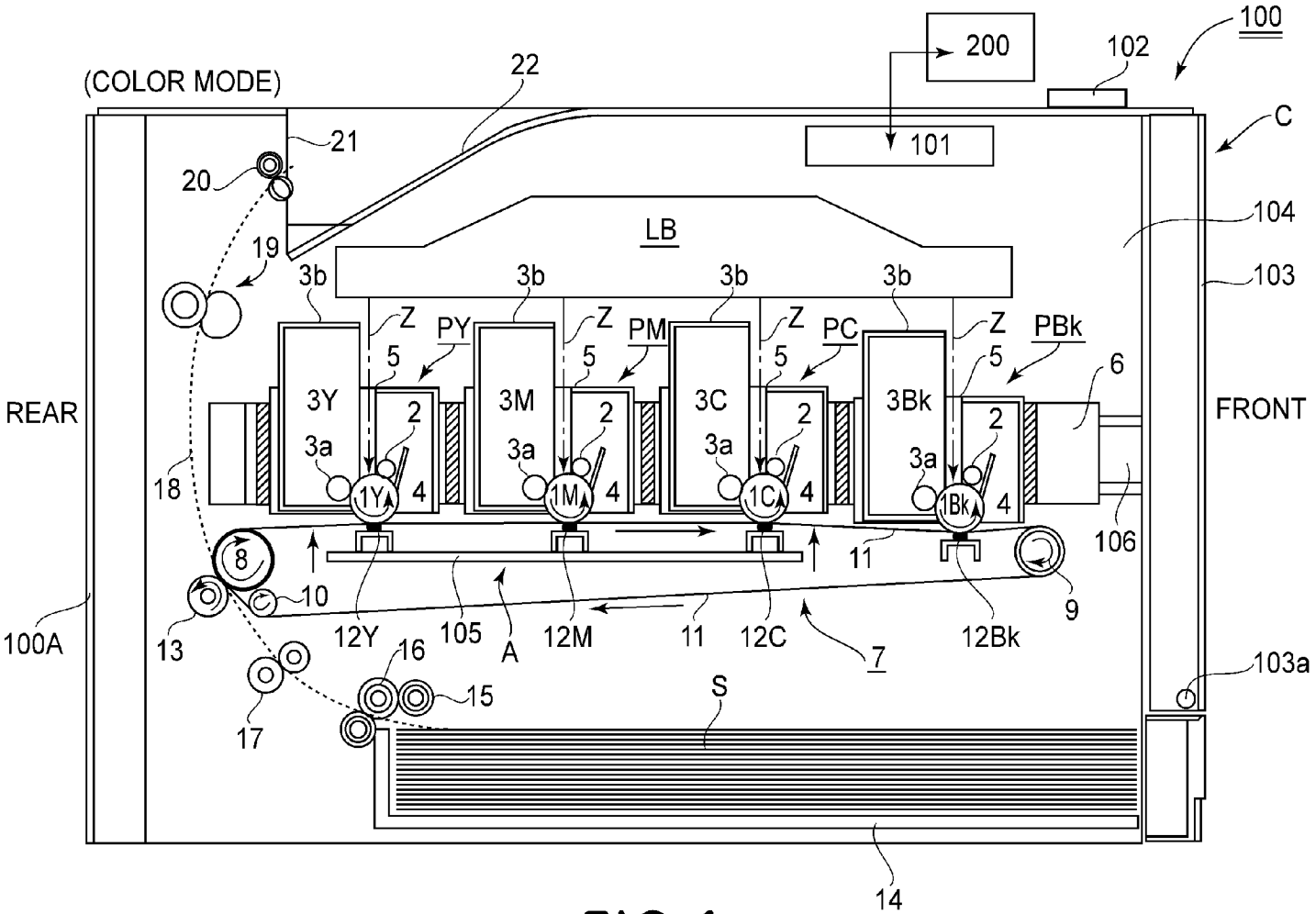
FIG. 1 is a schematic sectional view of an image forming apparatus according to Embodiment 1 during an operation in a color mode.

An image forming apparatus 100 according to this embodiment will be described with reference to FIG. 1 showing a schematic sectional view of the image forming apparatus. This image forming apparatus 100 is a full-color laser printer. That is, the image forming apparatus 100 forms a full-color image or a monochromatic image on a recording material S on the basis of image information (electric image signal) inputted from an external host device 200 into a control circuit portion (control means) 101. Incidentally, in the present invention, the image forming apparatus may be not only the printer but also another image forming apparatus such as a copying machine or a facsimile machine.

The external host device 200 is a personal computer, an image reader, the facsimile machine, a network system, a work station or the like. The image forming apparatus 100 includes an operating panel portion 102.

The image forming apparatus 100 is of a cartridge type in which the image is formed on the recording material S by a plurality of cartridges P contributing to an image forming process and detachably mounted in an image forming apparatus main assembly (hereinafter referred to an apparatus main assembly) 100A. In the image forming apparatus 100 in this embodiment, four process cartridges P (PY, PM, PC, PBk) are detachably mounted. Then, on the recording material S, the full-color image (color mode) or the monochromatic image (monochromatic mode) is formed.

Here, with respect to the image forming apparatus 100, a side where an openable door (openable member) 103 is provided is a front side (front surface side), and a side opposite from the front side is a rear side (rear surface side). Further, left and right sides are those as seen from the front side of the image forming apparatus 100. Inside the apparatus main assembly 100A, with respect to a predetermined direction from the rear side toward the front side, i.e., the horizontal direction in this embodiment, a first cartridge PY, a second cartridge PM, a third cartridge PC and a fourth cartridge PBk are provided in the listed order.

Each cartridge P is a process cartridge of a so-called integral type, and the respective cartridges P have the same electrophotographic process mechanism. That is, the respective cartridges P include electrophotographic photosensitive (members) drums (hereinafter referred to as drums) 1 (1Y, 1M, 1C, 1Bk), respectively, as rotatable image bearing members. Further, as electrophotographic process means actable on the drums 1, chargers 2, developing units (developing devices) 3 (3Y, 3M, 3C, 3Bk) and cleaning units 4 are provided.

The charger 2 is a charging means for electrically charging the drum 1 to a predetermined polarity and a predetermined potential, and is charging roller in this embodiment. The developing unit 3 includes a developing roller 3*a* as a developer carrying member for developing, as a toner image, an electrostatic latent image formed on the drum surface by carrying a developer (hereinafter referred to as a toner) and then by supplying the toner to the drum 1, and a toner accommodating portion 3*b* where the toner to be fed to the developing roller 3*a* is accommodated (stored).

The colors of the toners accommodated in the toner accommodating portions 3*b* of the developing units 3 of the cartridges P are different from each other. In this embodiment, the toner of yellow (Y) is accommodated in the toner accommodating portion 3*b* of the developing unit 3Y of the first cartridge PY. The toner of magenta (M) is accommodated in the toner accommodating portion 3*b* of the developing unit 3M of the second cartridge PM. The toner of cyan (C) is accommodated in the toner accommodating portion 3*b* of the developing unit 3*c* of the third cartridge PC. The toner of black (Bk) is accommodated in the toner accommodating portion 3*b* of the developing unit 3Bk of the fourth cartridge PBk.

The cleaning unit 4 is a cleaning means for cleaning the drum surface by removing the toner remaining on the drum surface after the toner image is primary-transferred from the drum 1 onto a transfer belt 11 described later. In this embodiment, as a cleaning member, a cleaning blade is used.

Each cartridge P is placed at and supported by a mounting portion corresponding to a cartridge supporting member (hereinafter referred to as a tray) 6 as a movable member described later with respect to a longitudinal direction (rotational axis direction of the drum 1) which is a left-right direction.

In FIG. 1, the tray is positioned inside the apparatus main assembly 100A and positions the respective cartridges P in corresponding accommodating positions as mounting positions in which an image forming operation is capable of being performed. The door 103 is closed relative to an opening 104 at the front surface of the apparatus main assembly 100A. In this state, each cartridge P is positioned and fixed in the mounting portion enabling the image forming operation by being urged against a positioning portion of the apparatus main assembly 100A at a positioned portion thereof by an urging operation of an urging means in the apparatus main assembly 100A side. In the above, each of the urging means, the positioned portion and the positioning portion is omitted from illustration in FIG. 1.

Then, in a state in which each cartridge P is positioned and fixed in the mounting position in the apparatus main assembly 100A, a driving coupling portion of the apparatus main assembly 100A is connected with a driven-coupling portion of each cartridge P. As a result, a driving force is capable of being transmitted from each of the driving portions of the apparatus main assembly 100 to the corresponding cartridge P. The drum 1 of each cartridge P is rotationally driven, by being subjected to transmission of the driving force described above, in the counter clockwise direction indicated by an arrow at a predetermined peripheral speed (process speed). Further, other rotatable members such as the developing rollers 3*a* of the developing units 3 are also rotationally driven in predetermined directions at predetermined speeds.

Further, to electric power receiving portions of the cartridges P, electric power supplying portions of the apparatus main assembly 100A are electrically connected, respectively. As a result, from power source portions of the apparatus main assembly 100A to the respective cartridges P, predetermined biases such as a charging bias and a developing bias are applicable. In the above, each of the driven-coupling portion, the driving coupling portion, the electric power receiving portion, the electric power supplying portion and the power source portion is omitted from illustration.

Above the four cartridges P, a laser scanner unit LB as an exposure means is provided. This unit LB outputs laser light Z modulated corresponding to the image information for the corresponding cartridge P. A constitution in which the laser light Z enters the cartridge P through an exposure window portion 5 of the cartridge P to subject the surface of the drum 1 to main scanning exposure is employed.

Further, below the four cartridges P, an intermediary transfer belt unit 7 is provided. This unit 7 includes, as a belt stretching member, a driving roller 8, a tension roller (supporting roller) 9 and an assist roller 10. Around these three rollers, a transfer belt (intermediary transfer member) 11 as a flexible endless belt is stretched. A transfer brush belt portion in an upper side between the driving roller 8 and the tension roller 9 opposes the drums 1 of the four cartridges P.

In this embodiment, the driving roller 8 is provided closer to a rear side than the first cartridge PY in the apparatus main assembly 100A. The tension roller 9 is provided closer to a front side than the fourth cartridge PBk in the apparatus main assembly 100A. The assist roller 10 is provided in the neighborhood of and below the driving roller 8.

The driving roller 8, the tension roller (supporting roller) 9 and the assist roller 10 are disposed in parallel to each other with respect to the rotational axis direction as the left-right direction. The tension roller 9 is always moved and urged, at bearing portions (not shown) of left and right end portions thereof by an urging means (not shown) such as a spring, in a direction in which a predetermined tension as a constant pressure is applied to the transfer belt 11. The transfer belt 11 is rotationally driven in the clockwise direction indicated by an arrow at the substantially same peripheral speed as the rotational peripheral speed of the drum 1 by rotational drive of the driving roller 8 in the clockwise direction indicated by an arrow. The tension roller 9 and the assist roller 10 are rotated by the rotation of the transfer belt 11.

Inside the transfer belt 11, as a transfer member (primary transfer means) opposing the lower drum surfaces of the respective cartridges P via the upper-side belt portion, four transfer brushes 12 (12Y, 12M, 12C, 12Bk) are provided in parallel with respect to the longitudinal direction as the left-right direction.

Of these transfer brushes 12Y, 12M, 12C and 12Bk, the transfer brushes 12Y, 12M and 12C corresponding to the first to third cartridges, PY, PM and PC are fixed to and supported by a common movable supporting member 105. The transfer brush 12Bk corresponding to the fourth cartridge PBk is fixed and disposed, as a specific transfer member, in a predetermined (constant) position.

That is, the drum (first image bearing member) 1Bk corresponding to the transfer brush 12Bk as the specific transfer member (first transfer member) is disposed downstream of the drums 1Y, 1M and 1C, as second image bearing members, corresponding to other transfer brushes (second transfer members) 12Y, 12M and 12C, respectively, with respect to a movement direction of the transfer belt 11.

Figure 6:
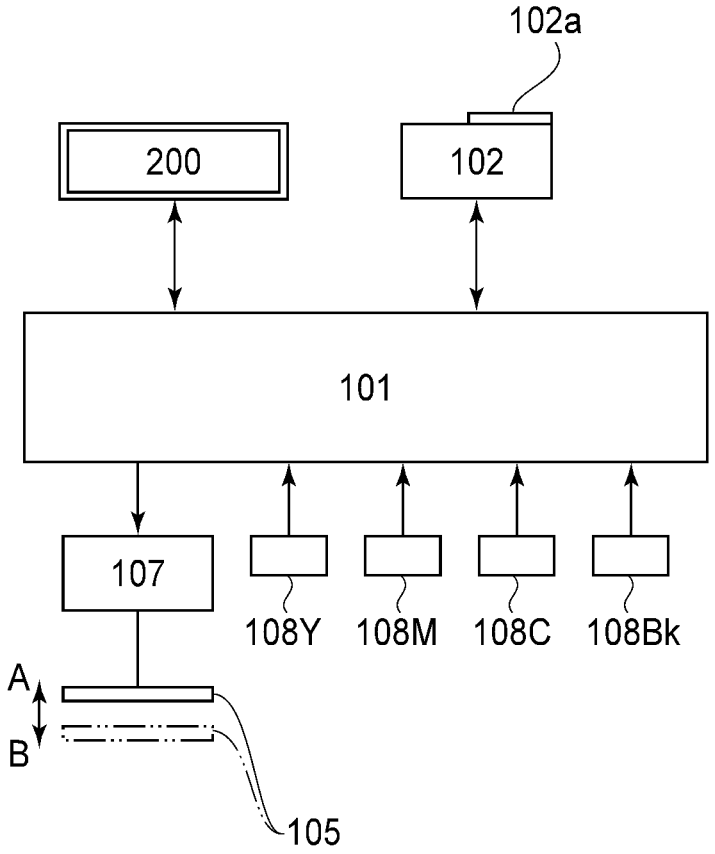
FIG. 6 is a block diagram of a control system.

The supporting member 105 is moved in an up-down direction while being kept in a horizontal state in an inside of the transfer belt 11 by a shift mechanism 107 (FIG. 6) controlled by the control circuit portion 101. Although specific constituent elements of the shift mechanism 107 for the supporting member 105 are omitted from the figures in order to avoid complication of the figures, e.g., the shift mechanism can be constituted by a parallelogram link raising and lowering motion mechanism driven by a motor, a raising and lowering motion mechanism including a cam driven by a motor or a solenoid, or the like mechanism.

The supporting member 105 is driven by the shift mechanism 107, so that the transfer brushes 12Y, 12M and 12C are moved between a contact position A with the upper-side belt portion toward the lower surfaces of the drums 1Y, 1M and 1C and a spaced position B from the drums 1Y, 1M and 1C. In this embodiment, the supporting member 105 and the shift mechanism 107 constitute a moving means for moving the transfer brushes 12Y, 12M and 12C, relative to the corresponding drums 1Y, 1M and 1C, between the contact position A and the spaced position B.

Figure 7:
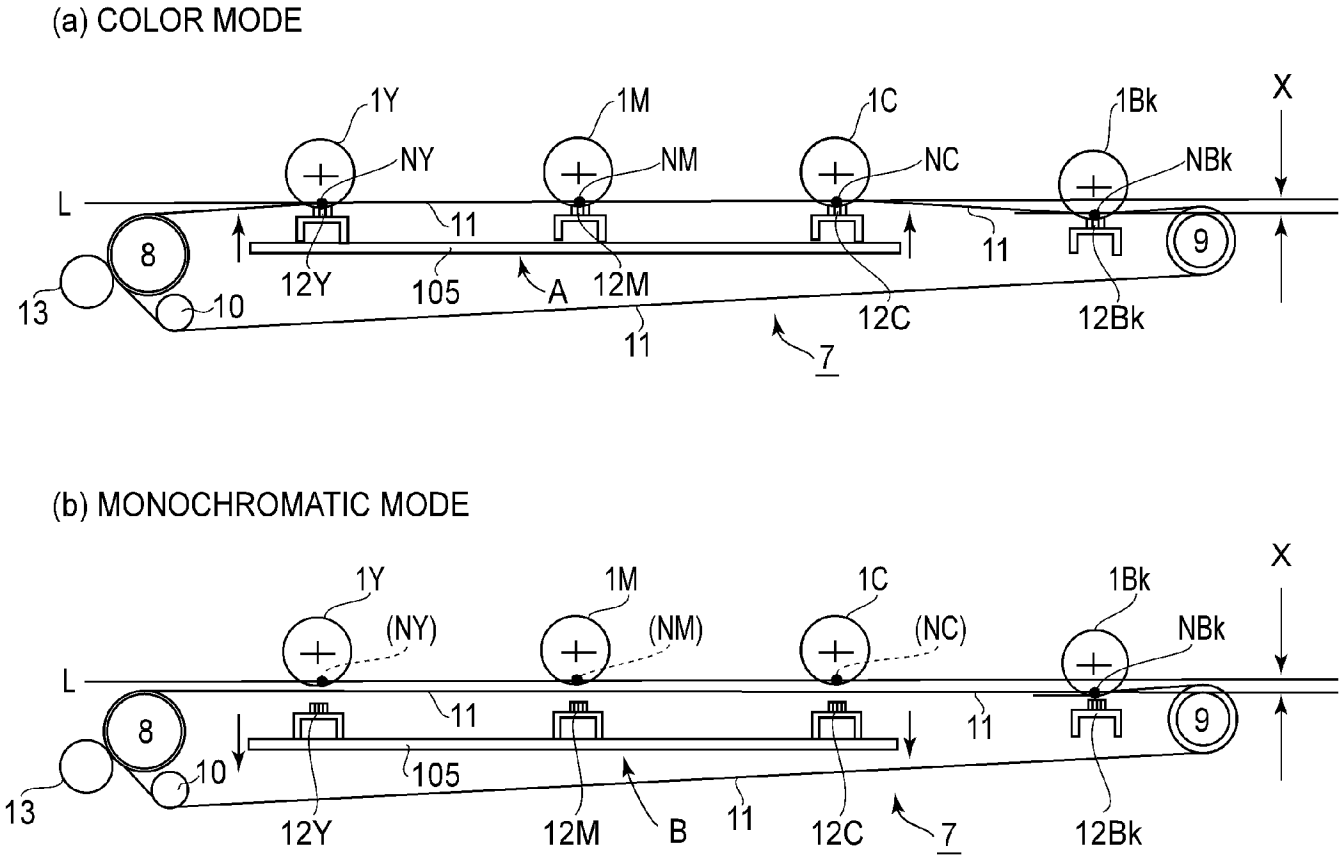
In FIG. 7, (a) is an enlarged schematic view of an intermediary transfer belt unit portion in FIG. 1, and (b) is an enlarged schematic view of an intermediary transfer belt unit portion in FIG. 2.

FIG. 1 shows a state in which the transfer brushes 12Y, 12M and 12C are moved to the contact position A. In FIG. 7, (a) is an enlarged schematic view of an intermediary transfer belt unit 7 portion in FIG. 1. In this state, the transfer brushes 12Y, 12M and 12C raise the transfer belt 11 against belt tension by upward movement of the supporting member 105 to move the transfer belt 11 in a direction of contact with the lower surfaces of the drums 1Y, 1M and 1C, thus placing the transfer belt 11 in an abutment state against the drums at a predetermined urging force. The transfer brush 12Bk fixed and disposed in the constant position is urged against and contacted to the transfer belt 11 toward the lower surface of the drum 1Bk of the fourth cartridge PBk at a predetermined urging force. The position of the supporting member 105 at this time is a first position.

That is, as shown in (a) of FIG. 7, a state in which the transfer belt 11 contacts the drums 1 of all of the cartridges P to form primary transfer nips (primary transfer positions) in respective contact positions NY, NM, NC and NBk, respectively, is created.

Figure 2:
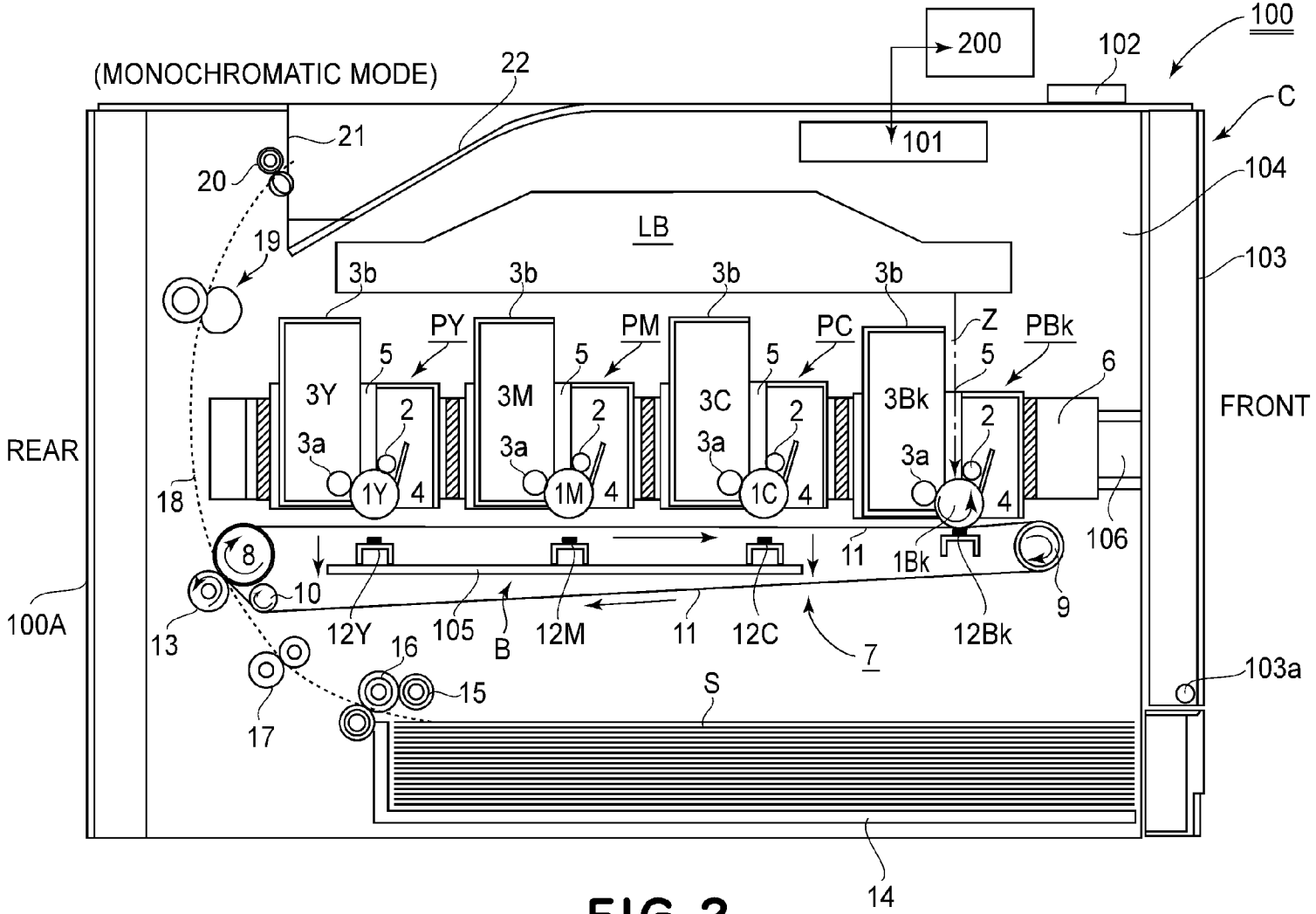
FIG. 2 is a schematic sectional view of the image forming apparatus in Embodiment 1 during an operation in a monochromatic mode.

FIG. 2 shows a state in which the transfer brushes 12Y, 12M and 12C are moved from the contact position A to the spaced position B. In FIG. 7, (b) is an enlarged schematic view of an intermediary transfer belt unit 7 portion in FIG. 2. In this state, each of the transfer brushes 12Y, 12M and 12C is spaced (separated) from the inner surface of the upper-side belt portion of the transfer belt 11. For that reason, as shown in (b) of FIG. 7, the upper-side belt portion of the transfer belt 11 is spaced from the lower surfaces of the drums 1Y, 1M and 1C of the first to third cartridges PY, PM and PC to be kept in a state in which formation of the primary transfer nips is eliminated. The position of the supporting member 105 at this time is a second position.

That is, the spaced position B of the transfer brushes 12Y, 12M and 12C is a position in which the transfer brushes 12Y, 12M and 12C are moved in the spaced direction from the corresponding positions 1Y, 1M and 1C by a predetermined amount to be placed in an eliminated state of formation of the primary transfer nips.

On the other hand, with respect to the transfer brush 12Bk fixed and disposed in the constant position, a state in which the transfer brush 12Bk is urged against and contacted to the upper-side belt portion toward the lower surface of the drum 1Bk of the fourth cartridge PBk is maintained. As a result, with respect to the fourth cartridge PBk, a state in which the transfer belt 11 contacts the drum 1Bk therefor to form the primary transfer nip at the contact position NBk is created.

In this state, in both of the color mode and the monochromatic mode, a winding amount of the tension 9 around the tension roller 9 is increased compared with that in a state in which the primary transfer nip is not formed. Accordingly, in both of the color mode and the monochromatic mode, stability of the drive of the transfer belt 11 is stabilized.

As described above, the transfer brush 12Bk as the specific transfer member is maintained in an urged state toward the drum 1Bk via the transfer belt 11 irrespective of the movement of the transfer brushes 12Y, 12M and 12C as other transfer members to the contact position A or the spaced position B.

Further, at a belt contact portion of the driving roller 8 of the unit 7, a secondary transfer roller 13 is urged against and contacted to the transfer belt toward the driving roller 8 at a predetermined urging force to form a secondary transfer nip (secondary transfer position).

Below the unit 7, a feeding tray (feeding cassette) 14 in which sheets of the recording material S on which the image is to be formed are stacked and accommodated, a pick-up roller 15, a single-sheet separating and feeding roller 16, a registration roller 17 and the like are provided. The recording material S is a sheet-like member on which the image is formable and includes plain paper, resin-coated paper, an OHP sheet, an envelope, a postcard, and the like (hereinafter referred to as a sheet) of various types including a regular (standard) size and an irregular (non-standard) size.

The feeding tray 14 is freely inserted (mounted) into and pulled out (demounted) from the front side of the apparatus main assembly 100A (front loading). The pick-up roller 15, the single-sheet feeding roller 16 and the registration roller 17 are disposed inside and in the rear side of the apparatus main assembly 100A. Further, in the inside and the rear side of the apparatus main assembly 100A, an upward sheet feeding path (vertical feeding path) 18 from the feeding roller 16 toward an upper discharge opening 21 of the apparatus main assembly 100A is provided. Along this feeding path 18, from a lower side to an upper side, the single-sheet feeding roller 16, the registration roller 17, the secondary transfer roller 13, a fixing device 19, a discharging roller pair 20 and the discharge opening 21 are provided successively in the listed order.

An upper surface portion of the apparatus main assembly 100A constitutes a discharge tray 22. The fixing device 19 fixes an unfixed toner image, as a fixed image, formed on the sheet S. In this embodiment, the fixing device 19 includes a pressing roller and a heating unit including a fixing film to be heated by a heating means, and fixes the toner image on the sheet S at a fixing nip formed between the pressing roller and the heating unit. The discharging roller pair 20 includes discharging rollers. The feeding path 18 includes a guide plate for guiding the sheet and the like but the guide plate and the like are omitted from FIG. 1.

(Image Forming Operation)

1) Color Mode

The color mode is an image forming mode in which a four-color based full-color image is formed on the sheet S by using all of the drums 1Y, 1M, 1C and 1Bk of the first to fourth cartridges PY, PM, PC and PBk.

When this color mode is selected and designated, the control circuit portion 101 operates, in the case where the supporting member 105 is not positioned in a predetermined raised position A, the shift mechanism 107 to move upward the supporting member 105 to the predetermined raised position A. As a result, as shown in FIG. 1 and (a) of FIG. 7, the transfer brushes 12 corresponding to the drums 1 of all of the first to fourth cartridges P are contacted to the transfer belt 11 toward the drums 1 to be placed in a state in which the primary transfer nips are formed at the contact positions NY, NM, NC and NBk, respectively.

The drum 1 of each cartridge P is rotationally driven at a predetermined control speed. Also the transfer brush belt 11 is rotationally driven in the same direction as a rotational direction of the drum 1. The laser scanner unit LB is also driven. In synchronization with the driving of the laser scanner unit LB, the charging roller 2 in each cartridge P uniformly electrically charges the surface of the drum 1 to predetermined polarity and potential. The laser scanner unit LB scans (exposes) the surface of each drum 1 with the laser light 8 depending on the image signal for a corresponding color. As a result, an electrostatic latent image corresponding to the image signal for the corresponding color is formed on the surface of the drum 1. The electrostatic latent image is developed by the developing roller of the developing unit 3 into a toner image.

By the above-described electrophotographic image forming process operation, a yellow (Y) toner image which corresponds to the yellow (Y) component of a full-color image is formed on the drum 1Y of the first cartridge PY, and the toner image is primary-transferred onto the transfer belt 11. On the drum 1M of the second cartridge PM, a magenta (M) toner image which corresponds to the magenta (M) component of the full-color image is formed, and the toner image is primary-transferred onto the transfer belt 11 so that it is superposed on the Y toner image which has already been transferred on the transfer belt 11.

Further, on the drum 1C of the third cartridge PC, a cyan (C) toner image which corresponds to the cyan (C) component of the full-color image is formed, and the toner image is primary-transferred onto the transfer belt 11 so that it is superposed on the Y and M toner images which have already been transferred onto the transfer belt 11. On the drum 1Bk of the fourth cartridge PK, a black (Bk) toner image which corresponds to the black (Bk) component of the full-color image is formed, and the toner image is primary-transferred onto the transfer belt 11 so that it is superposed on the Y, M and C toner images which have already been transferred on the transfer belt 11.

To the transfer brushes 12Y, 12M, 12C and 12Bk, a primary transfer bias may also be applied as desired. In this way, an unfixed full-color superposed transfer toner image is formed on the transfer belt 11 by the toner images of the four colors of Y, M, C and Bk.

On the other hand, from the feeding tray 14, at predetermined control timing, sheets S are separated and fed one by one. The sheet S is introduced into the secondary transfer nip, as a contact portion between the secondary transfer roller 13 and the transfer belt 11, at predetermined control timing by the registration roller 17. As a result, in a process in which the sheet S is nipped and fed through the secondary transfer nip, the superposed four color toner images on the transfer belt 11 are successively secondary-transferred collectively onto the surface of the sheet S. To the secondary transfer roller 13, a secondary transfer bias may also be applied as desired.

Then, the sheet S on which the toner images are secondary-transferred is introduced into the fixing device 19 to be subjected to fixing, and thereafter is discharged by the discharging roller pair 20, as a full-color image-formed product, onto the discharge tray 22 through the discharge opening 21.

2) Monochromatic Mode

The monochromatic mode (reduced color mode) is an image forming mode in which a monochromatic image is formed on the sheet S by using only the drum 1Bk of the fourth cartridge PBk, for forming the Bk toner image, of the first to fourth cartridges PY, PM, PC and PBk.

When this monochromatic mode is selected and designated, the control circuit portion 101 operates, in the case where the supporting member 105 is not positioned in a predetermined lowered position B, the shift mechanism 107 to move downward the supporting member 105 to the predetermined lowered position B. As a result, as shown in FIG. 2 and (b) of FIG. 7, the transfer brushes 12Y, 12M and 12C corresponding to the drums 1Y, 1M and 1C of the first to third cartridges PY, PM and PC are spaced (separated) from the inner surface of the upper-side belt portion of the transfer belt 11.

For that reason, the upper-side belt portion of the transfer belt 11 is spaced from the lower surfaces of the drums 1Y, 1M and 1C of the first to third cartridges PY, PM and PC and is held in a state in which the formation of the primary transfer nips is eliminated. That is, the transfer brushes 12Y, 12M and 12C are held in the spaced state from the opposing drums 1Y, 1M and 1C.

On the other hand, the transfer brush 12Bk fixed and disposed in the constant position is maintained in a state in which the transfer brush 12Bk is urged against and contacted to the upper-side belt portion of the transfer belt 11 toward the lower surface of the drum 1Bk of the corresponding fourth cartridge PBk at a predetermined urging force. As a result, the fourth cartridge PBk is placed in a state in which formation of the contact position NBk, i.e., the primary transfer nip, is maintained.

Then, the drum 1Bk of the fourth cartridge PBk is rotationally driven at a predetermined speed. Incidentally, with respect to the first to third cartridges PY, PM and PC, drive of the drums 1Y, 1M and 1C is not made, so that the image forming operation is not performed. The transfer belt 11 is rotationally driven in the same direction as the rotational direction of the drum 1Bk at a speed corresponding to the rotational speed of the drum 1Bk. The laser scanner unit LB is driven. In this state, image formation by only the fourth cartridge PBk is executed, so that the Bk toner image is formed on the drum 1Bk. Then, the Bk toner image is successively primary-transferred onto the transfer belt 11.

Thereafter, similarly as in the case of the color mode, from the feeding tray 14, one of sheets S is separated and fed. At the secondary transfer nip, the Bk toner image in the transfer belt 11 side is secondary-transferred onto the sheet S. The sheet S is introduced into the fixing device 19 to be subjected to image fixing, and thereafter is discharged by the discharging roller pair 20, as a monochromatic image-formed product, onto the discharge tray 22 through the discharge opening 21.

(Cartridge Exchange)

With use of each of the cartridges P for image formation, the toner accommodated in the toner accommodating portion 3*b* of the developing unit 3 is consumed. Then, when the toner is consumed to such an extent that an image of a quality satisfactory to a user who has purchased the cartridge P cannot be formed, commercial value of the cartridge P is lost.

Therefore, e.g., the image forming apparatus is provided with means 108Y, 108M, 108C and 108Bk (FIG. 6) for detecting an amount of the toner remaining in individual cartridge P. The detected remaining amount value is compared, by the control circuit portion 101, with a threshold (value) preset for providing a prewarning or warning of a lifetime of the cartridge P. When the detected remaining amount value is smaller than the preset threshold, the prewarning or warning of the lifetime of the associated cartridge P is displayed on a display portion 102*a* of the operating panel portion 102. As a result, the image forming apparatus prompts the user to prepare a cartridge for exchange, or to replace the cartridge P with a fresh cartridge, so that an output image quality is maintained.

In the image forming apparatus 100 in this embodiment, the exchange (replacement) of the cartridge P is performed through a method (type) in which the cartridge P is placed on a contact tray 6 as a movable member of a pulling-out type from the apparatus main assembly 100A, and then is replaced in a front-access manner in order to improve usability.

Figure 3:
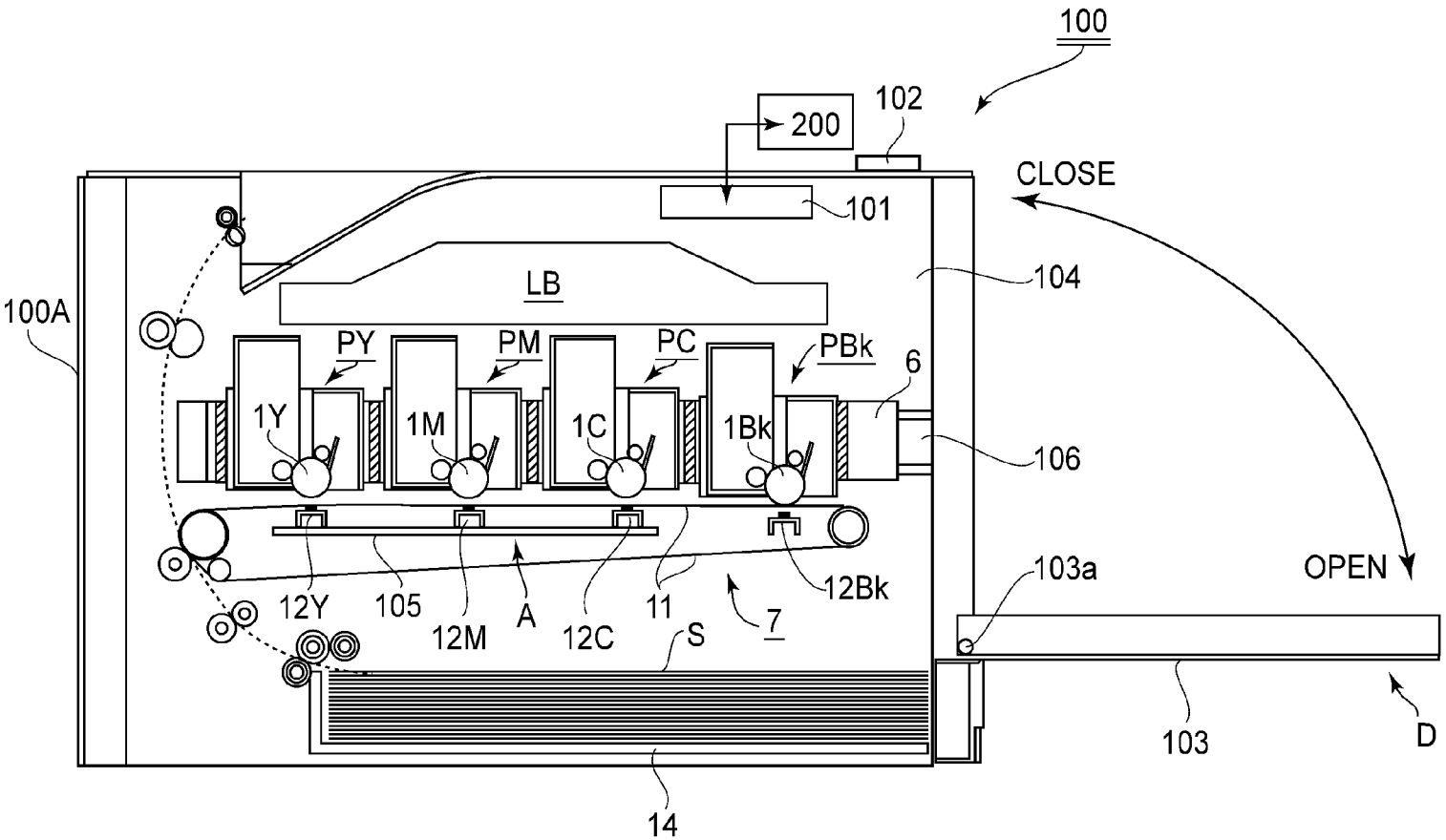
FIG. 3 is a schematic sectional view of the image forming apparatus in FIG. 1 in a state in which an openable door is open.
Figure 4:
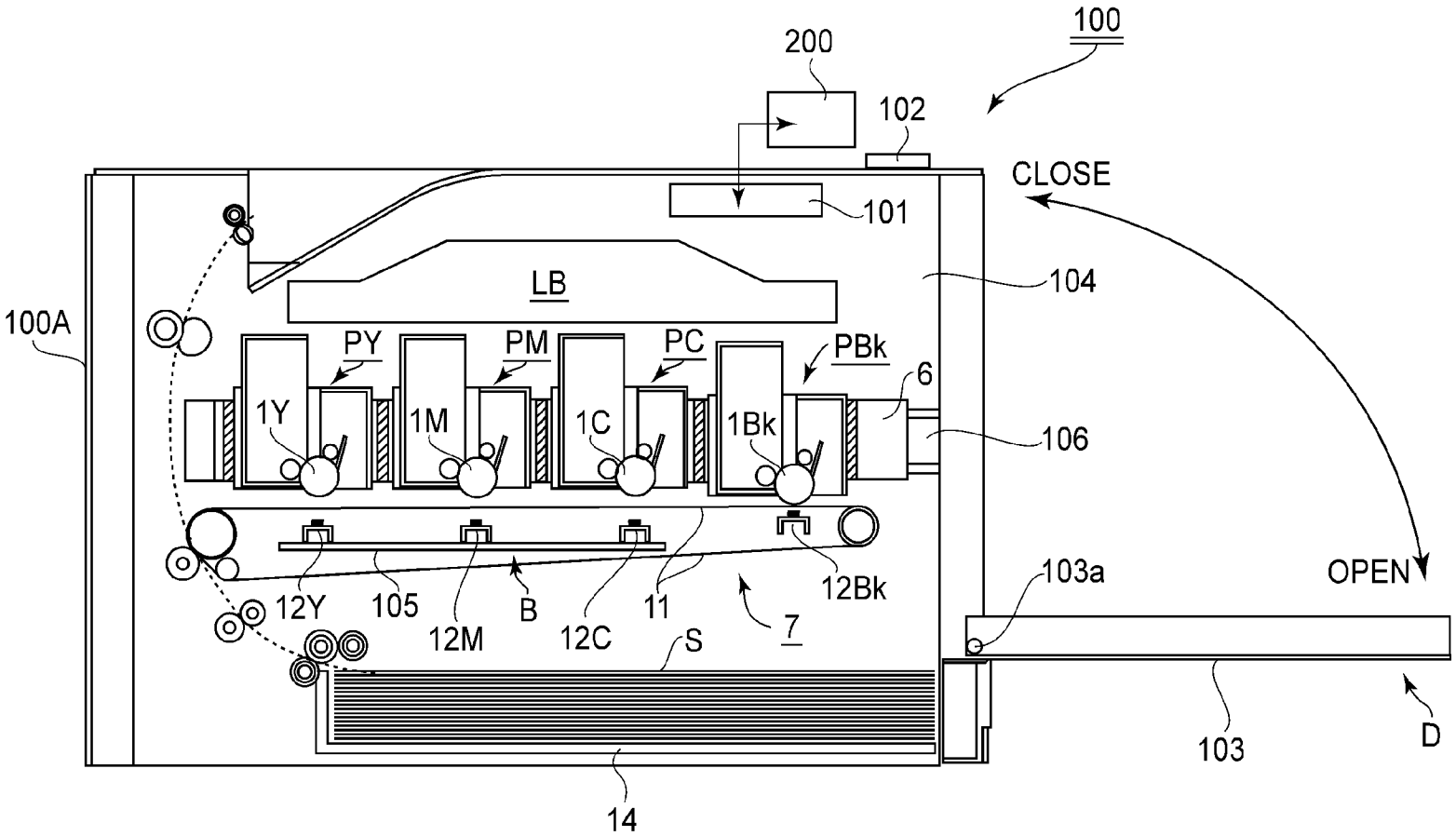
FIG. 4 is a schematic sectional view of the image forming apparatus in FIG. 2 in a state in which the openable door is open.

That is, in the front side of the apparatus main assembly 100A, an opening 104 through which the cartridge P passes in order that the cartridge P is inserted into the cartridge accommodating portion inside the apparatus main assembly 100A, and on the other hand, is taken out from the cartridge accommodating portion is provided. Further, the openable door 103 is movable between a closed position C where the opening 104 is closed (covered) as shown in FIGS. 1 and 2 and an open position D where the opening 104 is opened (exposed) as shown in FIGS. 3 and 4. That is, the door 103 is capable of taking the closed position C for covering the opening 104 and the open position D for exposing the opening 104.

In this embodiment, the door 103 can be opened and closed and can be rotationally moved relative to the apparatus main assembly 100A about a hinge shaft portion 103*a* provided in a lower side of the door 103. That is, the door 103 is rotated about the hinge portion 103 in an erection direction, so that the door 103 can be placed in the closed state relative to the apparatus main assembly 100A as shown in FIGS. 1 and 2. By closing the door 103, the opening 104 is closed (covered). Further, the door 103 is rotated frontward with respect to the apparatus main assembly 100*a* to the substantially horizontal position, about the hinge portion 103*a*, so that the door 103 can be placed in the open state relative to the apparatus main assembly 100A as shown in FIGS. 3 and 4. As a result, the opening 104 is largely opened.

Incidentally, FIG. 3 shows a state in which the door 103 is open when the transfer brushes 12Y, 12M and 12C are positioned in the contact position A. FIG. 4 shows a state in which the door 103 is open when the transfer brushes 12Y, 12M and 12C are positioned in the spaced position B.

The tray 6 is, in the state in which the door 103 is positioned in the closed position C as shown in FIGS. 1 and 2, positioned in an inside position where the door 103 is positioned inside the apparatus main assembly 100A and in an accommodating position where each cartridge P is positioned in a mounting position where the image forming operation is capable of being performed.

In this state, as described above, each cartridge P is urged against the positioning portion of the apparatus main assembly 100A at the positioned portion thereof by the urging operation of the urging means of the apparatus main assembly 100A, thus being positioned and fixed in the predetermined mounting position. Then, the driving coupling portion of the apparatus main assembly 100A is mechanically connected to the driven-coupling portion of each cartridge P. Further, the electric power supply portion of the apparatus main assembly 100A is electrically connected to the electric power receiving portion of each cartridge P.

When the door 103 is opened from the closed position C of FIGS. 1 and 2 to the open position D as shown in FIGS. 3 and 4, an interrelating mechanism (not shown) interrelated with the opening operation of the door 103 operates. By that operation, the connection of the driving coupling portion of the apparatus main assembly 100A with the driven-coupling portion of each cartridge P is eliminated (released). Further, the urging of each cartridge P by the urging means is eliminated. Then, the tray 6 is moved to a movable position, which is the inside position where the tray 6 is positioned inside the apparatus main assembly 100A, above the above-described accommodating position.

Figure 8:
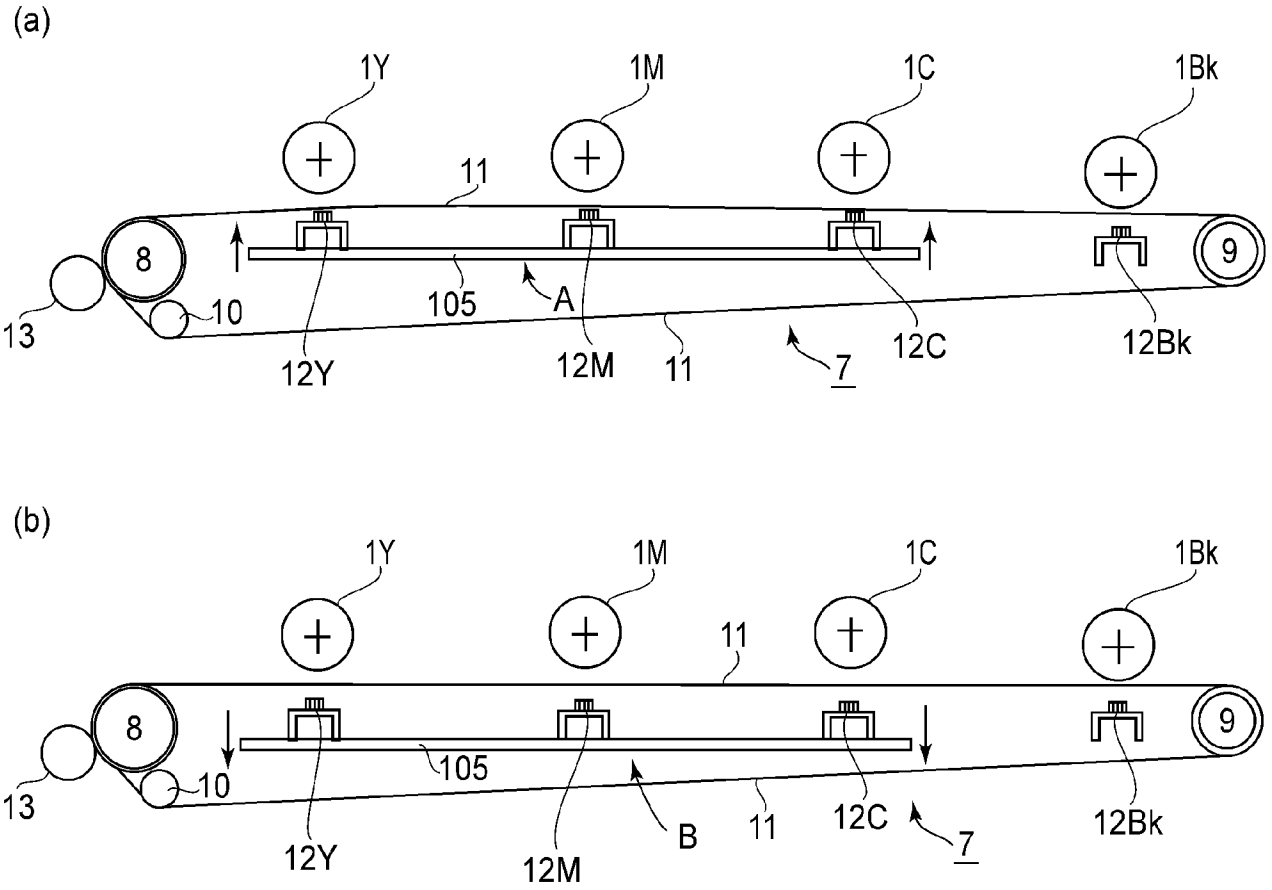
In FIG. 8, (a) is an enlarged schematic view of an intermediary transfer belt unit portion in FIG. 3, and (b) is an enlarged schematic view of an intermediary transfer belt unit portion in FIG. 4.

Then, by the upward movement of the tray 6 from the accommodating position to the movable position, also each cartridge P is raised from the mounting position, so that all of the drums 1 are held in the spaced state from the transfer belt 11. Further, the connection of the electric power supplying portion of the apparatus main assembly 100A with the electric power receiving portion of each cartridge P is also eliminated. In FIG. 8, (a) is an enlarged sectional view of an intermediary transfer belt unit 7 portion in FIG. 3, and (b) is an enlarged sectional view of an intermediary transfer belt unit 7 portion in FIG. 4.

In (a) of FIG. 8, in a state in which the transfer belt 11 is raised by the transfer brushes 12Y, 12M and 12C positioned in the contact position A, all of the drums 1Y, 1M, 1C and 1Bk are spaced from the transfer brush 11.

In (b) of FIG. 8, in a state in which the transfer belt 11 is spaced by the transfer brushes 12Y, 12M and 12C positioned in the spaced position B, all of the drums 1Y, 1M, 1C and 1Bk are spaced from the transfer brush 11. The upper-side belt portion of the transfer belt 11 is linearly extended and stretched between the driving roller 8 and the tension roller 9, so that the transfer belt 11 is spaced also from the transfer brush 12Bk.

Figure 5:
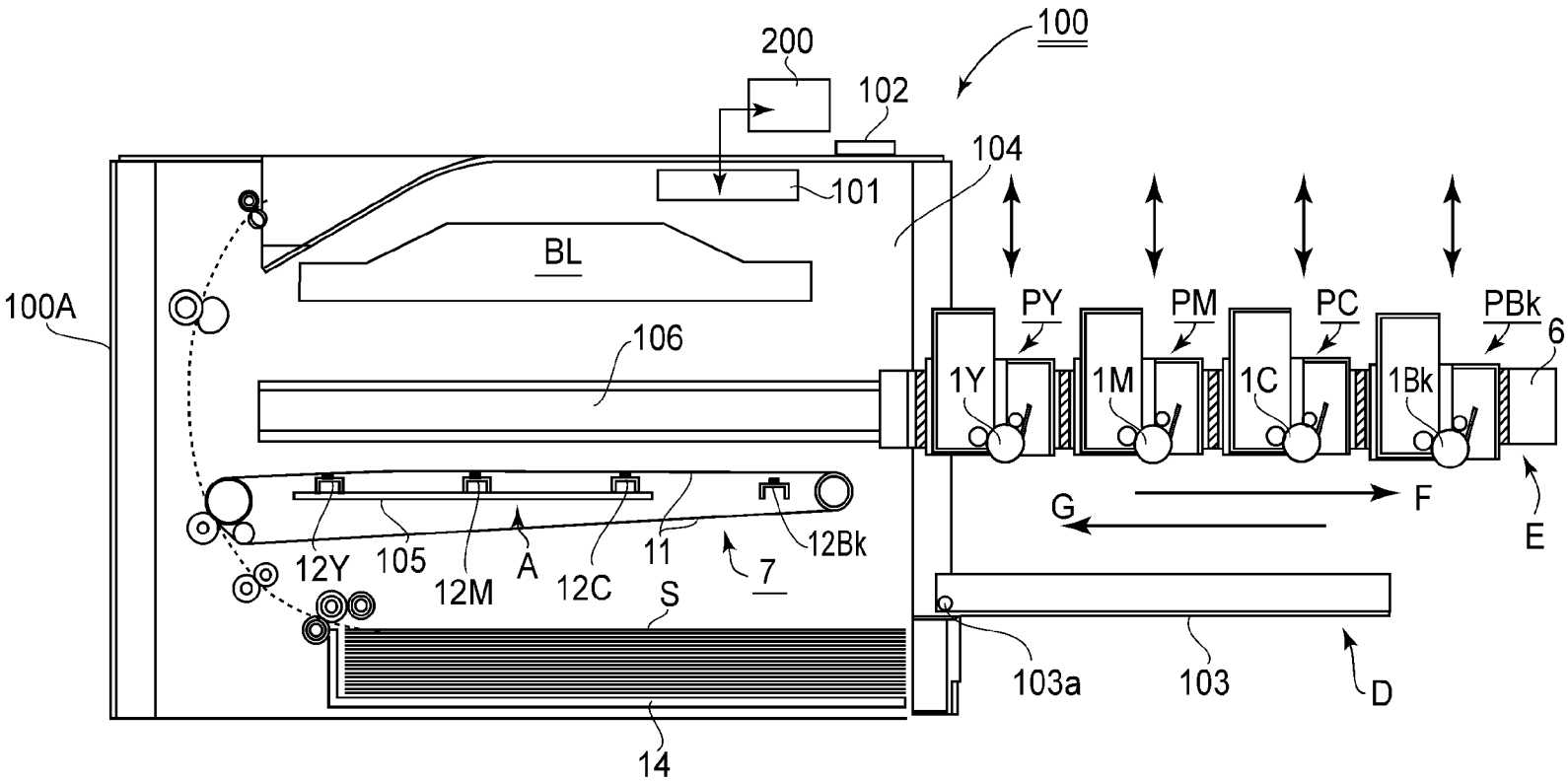
FIG. 5 is a schematic sectional view of the image forming apparatus in FIG. 3 in a state in which a tray is pulled out.

Then, the tray 6 is pulled out from the movable position of FIG. 4 to the outside of the apparatus main assembly 100A through the opening 104 as shown in FIG. 5, thus being capable of being pulled and moved to a predetermined mounting and demounting position (outside position) E. An arrow F represents a pulling-out movement direction of the tray 6. The pulling-out movement of the tray 6 is made along a long rail member 106, with respect to a front-rear direction of the apparatus main assembly 100A, by which the tray 6 is supported.

The tray 6 is movable along the rail member 106 in a direction perpendicular to (crossing) the longitudinal direction (rotational axis direction of the drum 1) of each cartridge P while supporting the four cartridges P. The tray 6 is capable of arranging and mounting thereon the four cartridges P with respect to the movement direction between the movable position of FIGS. 3 and 4 and the mounting and demounting position E. The fourth cartridge PBk for forming the Bk image is disposed in a downstreammost position of the tray 6 with respect to the pulling-out movement direction F of the tray 6.

As described above, the transfer belt 11 and the drum 1 of each cartridge P are spaced from each other during the movement of the tray 6, and therefore the tray 6 is moved from the movable position of FIGS. 3 and 4 to the mounting and demounting position E of FIG. 5 without contact between the drum 1 and the transfer belt 11. When the tray 6 is pulled out to the predetermined mounting and demounting position E, further pulling-out movement of the tray 6 is prevented by a stopper (not shown). Further, a pulled-out state is stably maintained. In this mounting and demounting position E, it is possible to perform an exchanging (replacing) operation between new and old cartridges P with respect to the tray 6.

The tray 6 supports each cartridge P in the mounting and demounting position E so as to be detachably movable upward. Further, the tray 6 supports each cartridge P by moving each carriage P downward. Therefore, the old (used-up) cartridge P to be replaced is raised and removed upward from the tray 6. Then, the new cartridge P is engaged in and placed on the tray 6 from above.

The tray 6 pulled out to the mounting and demounting position E is reversely capable of being pushed in and moved to the movable position as the inside position in the apparatus main assembly 100A through the opening 104. An arrow G represents a pushing-in movement direction of the tray 6. Also during this movement, the drum 1 of each cartridge P is held in the spaced state from the transfer belt 11, and the tray 6 is moved from the mounting and demounting position E to the movable position without contact between the drum 1 and the transfer belt 11.

Further, in a state in which the tray 6 is pushed into the movable position in a predetermined manner (FIGS. 3 and 4), the door 103 can be placed in the closed state with respect to the apparatus main assembly 100A. By an operation of an interrelating mechanism (not shown) interrelated with the closing operation of the door 103, the tray 6 is moved downward in a predetermined amount (distance) to be positioned (moved) from the movable position to the accommodating position. As a result, each cartridge P is positioned in the mounting position for permitting the image forming operation.

By a subsequent operation interrelated with the closing operation of the door 103, a connecting and engaging operation of the driving coupling portion of the apparatus main assembly 100A with the driven-coupling portion of each cartridge P is performed. Similarly, the urging means performs the urging operation to urge the positioned portion of each cartridge P against the positioning portion of the apparatus main assembly 100A, so that each cartridge P is held in a positioned state in a predetermined mounting position. Further, a state in which the electric power supplying portion of the apparatus main assembly 100A is electrically connected to the electric power receiving portion of each cartridge P is created. Thus, each cartridge P is restored to a state in which each cartridge P is capable of performing the image forming operation (FIGS. 1 and 2).

(Transfer Portion)

In (a) of FIG. 7 which is an enlarged schematic view of the unit 7 portion in the color mode, a rectilinear line (phantom line) connecting the contact positions NY, NM and NC of the transfer belt 11 with the drums 1Y, 1M and 1C opposing the transfer brushes 12Y, 12M and 12C, respectively, is taken as L. With reference to this rectilinear line L, the contact position NBk of the transfer belt 11 with the drum 1Bk corresponding to the transfer brush 12Bk as the specific transfer member is disposed in a direction in which the transfer belt 11 is pressed inward.

In this embodiment, in a state in which all of the cartridges P are positioned and fixed in the mounting positions, respectively, the drum 1Bk of the cartridge PBk is constituted to be positioned in a side closer to the transfer belt 11 than the drums 1Y, 1M and 1C of other cartridges PY, PM and PC.

Further, the contact position NBk between the drum 1Bk and the transfer belt 11 in this embodiment is disposed by being spaced downward from the rectilinear line L by a distance X in (a) of FIG. 7. In this embodiment, the contact position NBk between the drum 1Bk and the transfer belt 11 is disposed by setting the distance X at 2 mm.

Further, as shown in (b) of FIG. 7, when the transfer brushes 12Y, 12M and 12C are spaced from the drums 1Y, 1M and 1C during execution of the monochromatic mode, the contact position NBk is spaced from the rectilinear line L by the distance X. For that reason, the transfer brush 11 can be spaced from the drums 1Y, 1M and 1C. At this time, a distance of the transfer belt 11 from the drums 1Y, 1M and 1C is sufficiently large, and therefore, e.g., even in the case where the transfer belt 11 is waved by a track of setting or the like when the transfer belt 11 is stored for a long term, the transfer belt 11 is prevented from contacting the drums 1Y, 1M and 1C.

As described above, during execution of the monochromatic mode, the contact position NBk of the transfer belt 11 with the drum 1Bk on which the Bk image is to be formed is disposed in a direction in which other drums 1Y, 1M and 1C which are not subjected to the image formation are spaced from the transfer belt 11. For that reason, it is possible to sufficiently space other drums 1Y, 1M and 1C, which are not subjected to the image formation, from the transfer belt 11. As a result, in a relatively simple constitution, without upsizing the image forming apparatus 100, a degree of deterioration due to the contact of the transfer belt 11 with other drums 1Y, 1M and 1C which are not subjected to the image formation during output of the Bk image can be reduced.

Further, as shown in (b) of FIG. 7, during the execution of the monochromatic mode, the contact position NBk of the transfer belt 11 with the drum 1Bk on which the Bk image is to be formed is disposed in the direction in which other drums 1Y, 1M and 1C which are not subjected to the image formation are spaced from the transfer belt 11. In this case, in the contact position NBk of the transfer belt 11 with the drum 1Bk on which the Bk image is to be formed, the transfer belt 11 contacts the drum 1Bk in a more wound around state. As a result, in the image forming apparatus in this embodiment, a width of the primary transfer nip of the drum 1Bk for forming the Bk image is sufficiently ensured, and therefore it is possible to obtain a good transfer image free from improper transfer.

Figure 9:
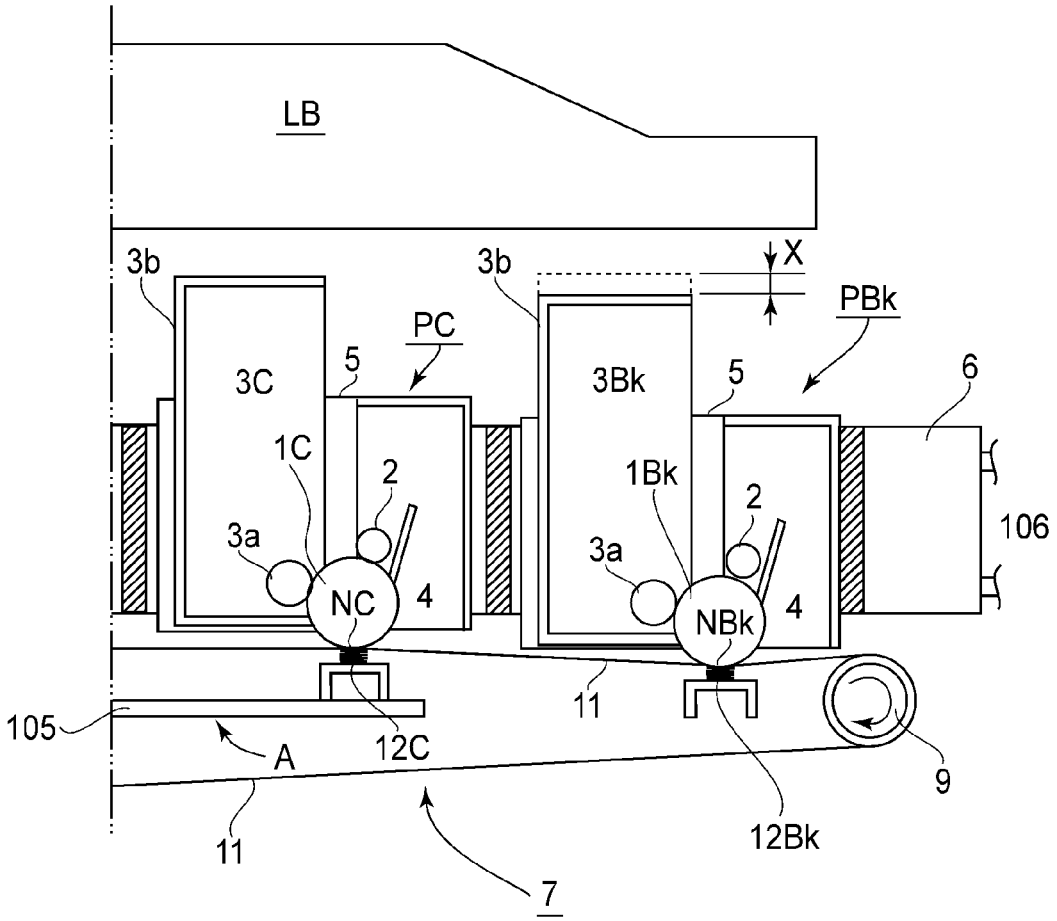
FIG. 9 is a partly enlarged view of FIG. 1.

Further, as described above, in the case where the contact position NBk of the transfer belt 11 with the drum 1Bk for forming the Bk image is disposed in a direction in which other drums 1Y, 1M and 1C are spaced from the transfer belt 11, the cartridge PBk can be disposed in a direction in which the cartridge PBk is lower than other cartridges. As a result, even when the toner accommodating portion 3*b* of the cartridge PBk is set to have a larger size than those of other cartridges by the distance X with respect to the up-down direction as indicated by a broken line in FIG. 9, the cartridge PBk can be disposed in the apparatus main assembly 100A without changing a size of the apparatus main assembly 100A.

In this embodiment, the cartridge PBk is disposed in the downstreammost position of the tray 6 with respect to the pulling-out direction of the tray 6 when the cartridges PY, PM, PC and PBk are exchanged (replaced). When the cartridge PBk is disposed in this position, there is no influence on an exchanging property of the cartridges PY, PM, PC and PBk even when the cartridge PBk is set to have the size larger than those of other cartridges by the distance X. As a result, in the image forming apparatus 100 in this embodiment, without changing the size of the apparatus main assembly 100A and impairing the cartridge exchanging property, the cartridge PBk having a high frequency of use can be replaced with a high-volume cartridge with respect to an accommodated toner amount.

Embodiment 2

Figure 10:
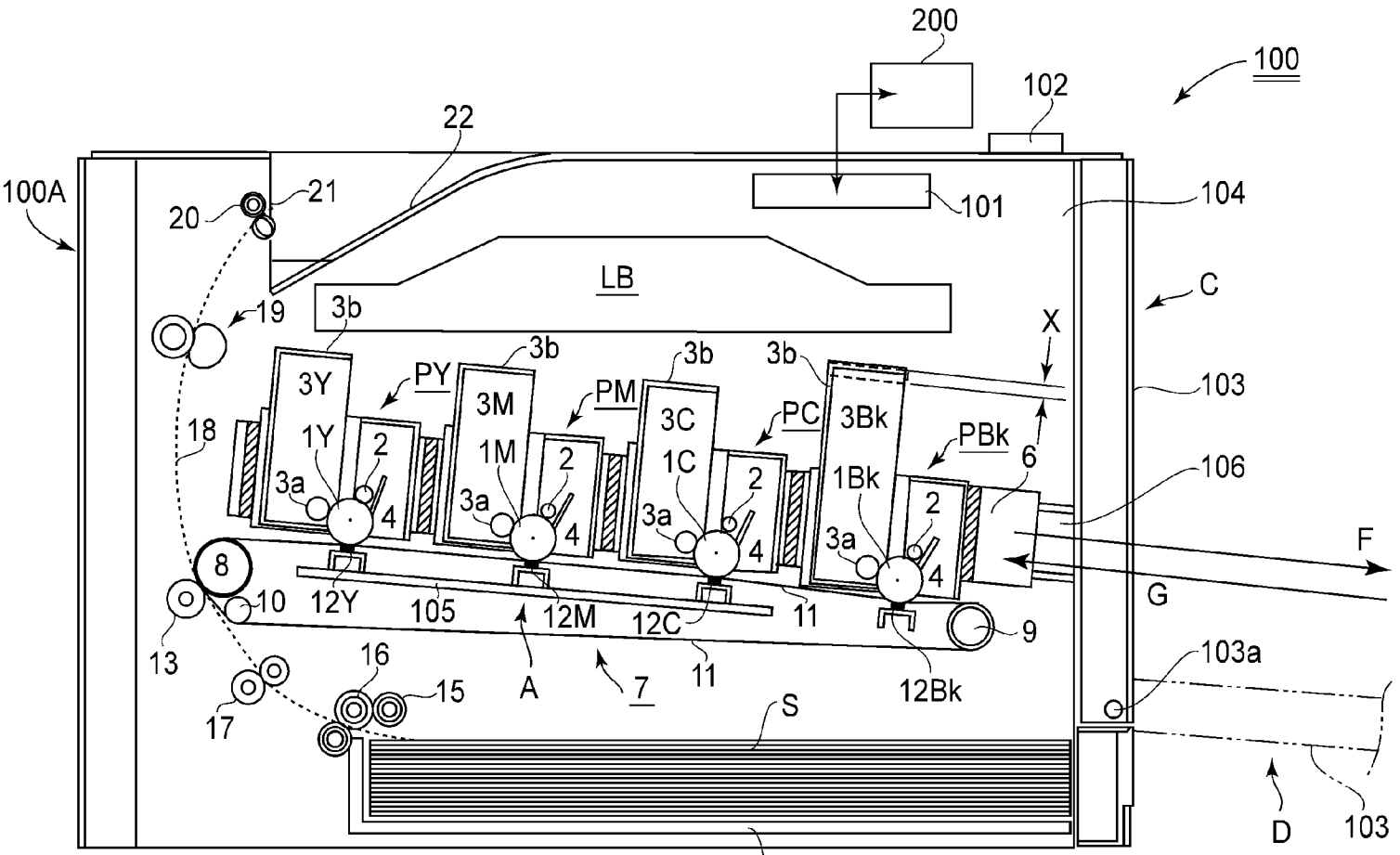
FIG. 10 is a schematic sectional view of an image forming apparatus according to Embodiment 2.

An image forming apparatus 100 according to Embodiment 2 will be described with reference to FIG. 10. In the image forming apparatus 100 in this embodiment, the tray 6 on which the first to fourth cartridges PY, PM, PC and PBk are supported is provided in an inclined state toward an obliquely lower-right direction in the apparatus main assembly 100A. That is, the tray 6 is disposed in the inclined state relative to the horizontal direction so that a downstream side thereof is lower than an upstream side thereof with respect to the pulling-out movement direction F.

With this disposition of the tray 6, also the intermediary transfer belt unit 7 is disposed in the inclined state so as to be in parallel to the inclined tray 6. The pulling-out movement direction F of the tray 6 from the apparatus main assembly 100A and the pushing-in movement direction G of the tray 6 into the apparatus main assembly 100A are set so as to be in parallel to a rectilinear line connecting the contacts 1Y, 1M and 1C of the first to third cartridges PY, PM and PC.

Constitutions of the image forming apparatus 100 other than the above-described constitution are the same as those in the image forming apparatus 100 in Embodiment 1. In this embodiment, the first to fourth cartridges PY, PM, PC and PBk are disposed in the listed order in the direction directed toward the lower-right position in the inclined state. For that reason, in a spacing relationship with the unit LB, even when the toner accommodating portions 3*b* of the first to fourth cartridges PY, PM, PC and PBk are set to have larger sizes in the listed order with respect to the up-down direction, the cartridges can be disposed in the apparatus main assembly 100A without changing a size of the apparatus main assembly 100A. In FIG. 10, only the toner accommodating portion 3*b* of the cartridge PBk having the high frequency of use is illustrated in a large-sized state.

In this case, also in Embodiment 2, similarly as in Embodiment 1, the contact position between the drum 1Bk and the belt 11 is disposed in the spaced direction of the belt 11 from the drums 1Y, 1M and 1C. For that reason, the size of the toner accommodating portion 3*b* of the contact PBk can be set at a further large value by the distance X described above.

Further, also in this embodiment, similarly as in Embodiment 1, the cartridge PBk is disposed in the downstreammost position of the tray 6 with respect to the pulling-out direction of the tray 6 when the cartridges PY, PM, PC and PBk are exchanged (replaced). When the cartridge PBk is disposed in this position, there is no influence on an exchanging property of the cartridges PY, PM, PC and PBk even when the toner accommodating portion 3*b* of the cartridge PBk is set to have the size larger than those of other cartridges by the sum of a distance corresponding to the above-described inclination disposition and the distance X. As a result, in the image forming apparatus 100 in this embodiment, without changing the size of the apparatus main assembly 100A and impairing the cartridge exchanging property, the cartridges can be replaced with cartridges having volumes, with respect to an accommodated developer amount, larger than those in Embodiment 1.

Other Embodiments (1) In Embodiments 1 and 2 described above, although the transfer brushes 12Y, 12M, 12C and 12Bk are used as the transfer member, the transfer member may also be a pad member or a roller member (transfer roller).

(2) The plurality of the image bearing members may also have a device constitution such that the image bearing members are assembled with the apparatus main assembly 100A or the tray 6 and are disposed in a tandem manner. Further, it is also possible to employ an image forming apparatus constitution in which the plurality of image bearing members are disposed in a tandem manner with respect to the up-down direction. It is also possible to employ an image forming apparatus constitution in which the number of the plurality of image bearing members is not limited to 4 in Embodiments 1 and 2 but may also be 2, 3 and 5 or more. The type of the rotatable image bearing members is not limited to the drum type but may also be an endless belt type.

(3) The rotatable and flexible endless belt member disposed opposed to the drums 1Y, 1M, 1C and 1Bk is not limited to the intermediary transfer member onto which the toner images are transferred from the drums 1 as in Embodiments 1 and 2, but may also be a recording material feeding member for feeding the recording material onto which the images are transferred from the drums 1.

Figure 11:
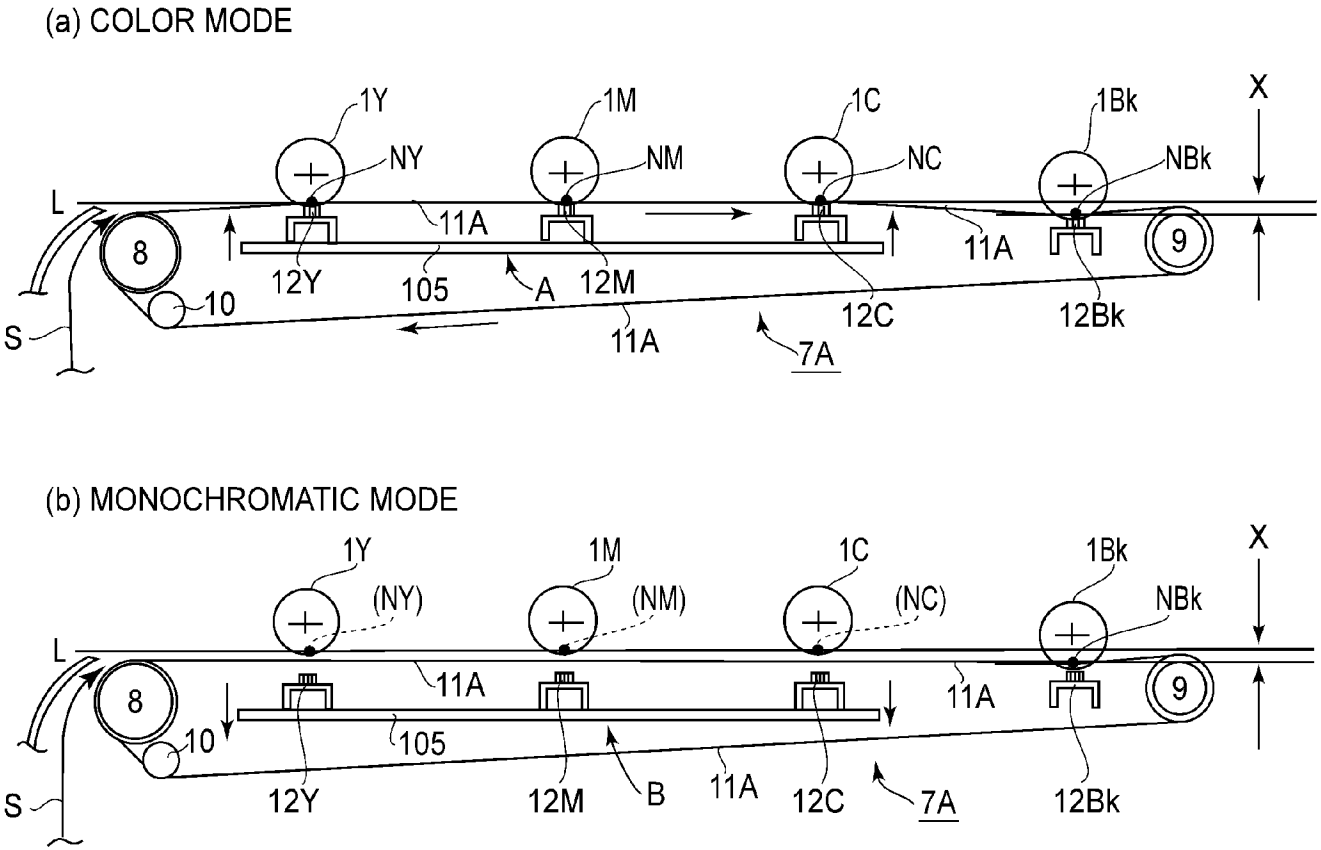
In FIG. 11, (a) and (b) are schematic sectional views of an image forming apparatus in another apparatus constitution.

In FIG. 11, (a) and (b) are schematic views each showing a principal part of the image forming apparatus in which the intermediary transfer belt unit 7 in Embodiment 1 is changed to a recording material feeding unit 7A. The unit 7A includes a recording material feeding member 11A as an endless belt member for carrying and feeding the sheet S as the recording material to an image transfer portion of each of the drums 1.

(4) The image forming type of each of the image forming portions is not limited to the electrophotographic type in Embodiments 1 and 2, but may also be an electrostatic recording image forming type using an electrostatic recording dielectric member as the image bearing member, a magnetic recording image forming type using a magnetic recording (magnetic) member as the image bearing member, and other image forming types.

According to the present invention, when the image-formed product using only the image bearing member corresponding to the specific transfer member is outputted, the contact position between the image bearing member and the belt member is disposed in the direction in which other image bearing members are spaced from the belt member. For that reason, it is possible to sufficiently increase the distance of the belt member from other image bearing members. As a result, in the relatively simple constitution, without upsizing the image forming apparatus, a degree of deterioration of other image bearing members and the belt member when the image-formed product using only the image bearing member corresponding to the specific transfer member is outputted can be reduced.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 031841/2013 filed Feb. 21, 2013, which is hereby incorporated by reference.

What is claimed is:

1. An image forming apparatus for forming an image on a recording material, comprising:

a rotatable first image bearing member;

a plurality of rotatable second image bearing members;

an endless belt member provided rotatably opposed to said first image bearing member and said second image bearing members;

a driving roller for rotating said belt member in contact with an inner peripheral surface of said belt member;

a supporting roller for supporting said belt member in contact with the inner peripheral surface of said belt member;

a first transfer member provided opposed to said first image bearing member via said belt member;

a plurality of second transfer members provided opposed to said second image bearing members, respectively, via said belt member; and a supporting member for moving said second transfer members, wherein said supporting member is movable between a first position in which said second transfer members are placed in a state in which said second transfer members are contacted to said belt member together with said second image bearing members to sandwich said belt member therebetween, and a second position in which said second transfer members are retracted from the first position to space said second image bearing members and said second transfer members from said belt member, wherein when image formation is effected in a state in which said supporting member is positioned in the first position, a nip between said first image bearing member and said belt member is positioned in a retracting direction of said second transfer members to be spaced from a rectilinear line connecting contact positions of said belt member with all of said plurality of rotatable second image bearing members.

2. An image forming apparatus according to claim 1, wherein when image formation is effected in a state in which said supporting member is positioned in the second position, the nip between said first image bearing member and said belt member is positioned in the retracting direction of said second transfer members to be spaced from the rectilinear line connecting contact positions where said belt member is in contact with said second image bearing members when said supporting member is positioned in the first position.

3. An image forming apparatus according to claim 1, wherein said belt member is an intermediary transfer member onto which a developer image is transferred from said first and second image bearing members.

4. An image forming apparatus according to claim 1, wherein said belt member is a recording material feeding member for carrying and feeding the recording material onto which a developer image is transferred from said first and second image bearing members.

5. An image forming apparatus according to claim 1, wherein each of said first and second transfer members is a transfer brush.

6. An image forming apparatus according to claim 1, wherein each of said first and second transfer members is a transfer roller.

7. An image forming apparatus according to claim 1, wherein a black image is formed on said first image bearing member, and a cyan image, a yellow image and a magenta image are formed on said second image bearing members, respectively.

8. An image forming apparatus according to claim 1, wherein said supporting member is positioned in the first position in a color mode in which a full-color image is formed on the recording material, and is positioned in the second position in a monochromatic mode in which a black image is formed on the recording material.

9. An image forming apparatus according to claim 1, wherein said first transfer member is provided downstream of said second transfer members with respect to a movement direction in which said belt member moves from said driving roller toward said supporting roller.

10. An image forming apparatus according to claim 1, wherein said first image bearing member and said second image bearing members are provided in a plurality of cartridges, each being detachably mounted to a main assembly of said image forming apparatus.

11. An image forming apparatus according to claim 10, further comprising a movable member for supporting the plurality of cartridges, wherein said movable member is movable to a mounting position in which said movable member is positioned inside the main assembly and said first and second image bearing members can be contacted to said belt member, and a mounting and demounting position in which said movable member is pulled out to an outside of the main assembly to permit mounting and demounting of the plurality of cartridges, and wherein of the plurality of cartridges, the cartridge including said first image bearing member is disposed in a downstreammost position with respect to a pulling-out direction of said movable member.

12. An image forming apparatus according to claim 10, wherein of the plurality of cartridges, the cartridge including said first image bearing member has a volume, in which a developer is accommodated, larger than volumes of the cartridges including said second image bearing members.

13. An image forming apparatus according to claim 11, wherein said movable member is disposed in an inclined state with respect to a horizontal direction so that a downstream side thereof is lower than an upstream side thereof in the mounting position.

14. An image forming apparatus according to claim 1, wherein said belt member has flexibility.

15. An image forming apparatus for forming an image on a recording material, comprising:

a rotatable first image bearing member;

a plurality of rotatable second image bearing members;

an endless belt member provided rotatably opposed to said first image bearing member and said second image bearing members;

a driving roller for rotating said belt member in contact with an inner peripheral surface of said belt member;

a supporting roller for supporting said belt member in contact with the inner peripheral surface of said belt member;

a first transfer member provided opposed to said first image bearing member via said belt member;

a plurality of second transfer members provided opposed to said second image bearing members, respectively, via said belt member; and a supporting member for moving said second transfer members, wherein said supporting member is movable between a first position in which said second transfer members are placed in a state in which said second transfer members are contacted to said belt member together with said second image bearing members to sandwich said belt member therebetween, and a second position in which said second transfer members are retracted from the first position to space said second image bearing members and said second transfer members from said belt member, wherein when image formation is effected in a state in which said supporting member is positioned in the first position, a nip between said first image bearing member and said belt member is positioned in a retracting direction of said second transfer members to be spaced from a rectilinear line connecting contact positions of said belt member with said plurality of rotatable second image bearing members, and wherein said first transfer member is always contacted to said belt member together with said first image bearing member to sandwich said belt member therebetween.

16. An image forming apparatus according to claim 15, wherein when image formation is effected in a state in which said supporting member is positioned in the second position, the nip between said first image bearing member and said belt member is positioned in the retracting direction of said second transfer members to be spaced from the rectilinear line connecting contact positions where said belt member is in contact with said second image bearing members when said supporting member is positioned in the first position.

17. An image forming apparatus according to claim 15, wherein said belt member is an intermediary transfer member onto which a developer image is transferred from said first and second image bearing members.

18. An image forming apparatus according to claim 15, wherein said belt member is a recording material feeding member for carrying and feeding the recording material onto which a developer image is transferred from said first and second image bearing members.

19. An image forming apparatus according to claim 15, wherein each of said first and second transfer members is a transfer brush.

20. An image forming apparatus according to claim 15, wherein each of said first and second transfer members is a transfer roller.

21. An image forming apparatus according to claim 15, wherein a black image is formed on said first image bearing member, and a cyan image, a yellow image and a magenta image are formed on said second image bearing members, respectively.

22. An image forming apparatus according to claim 15, wherein said supporting member is positioned in the first position in a color mode in which a full-color image is formed on the recording material, and is positioned in the second position in a monochromatic mode in which a black image is formed on the recording material.

23. An image forming apparatus according to claim 15, wherein said first transfer member is provided downstream of said second transfer members with respect to a movement direction in which said belt member moves from said driving roller toward said supporting roller.

24. An image forming apparatus according to claim 15, wherein said first image bearing member and said second image bearing members are provided in a plurality of cartridges, each being detachably mounted to a main assembly of said image forming apparatus.

25. An image forming apparatus according to claim 24, wherein of the plurality of cartridges, the cartridge including said first image bearing member has a volume, in which a developer is accommodated, larger than volumes of the cartridges including said second image bearing members.

26. An image forming apparatus according to claim 24, further comprising a movable member for supporting the plurality of cartridges, wherein said movable member is movable to a mounted position in which said movable member is positioned inside the main assembly and said first and second image bearing members can be contacted to said belt member, and a mounting and demounting position in which said movable member is pulled out to an outside of the main assembly to permit mounting and demounting of the plurality of cartridges, and wherein of the plurality of cartridges, the cartridge including said first image bearing member is disposed in a downstreammost position with respect to a pulling-out direction of said movable member.

27. An image forming apparatus according to claim 26, wherein said movable member is disposed in an inclined state with respect to a horizontal direction so that a downstream side thereof is lower than an upstream side thereof in the mounted position.

28. An image forming apparatus according to claim 15, wherein said belt member has flexibility.

* * * * *